US011740014B2

(12) United States Patent
Prosser et al.

(10) Patent No.: US 11,740,014 B2
(45) Date of Patent: Aug. 29, 2023

(54) SYSTEM AND METHOD FOR NATURAL GAS AND NITROGEN LIQUEFACTION WITH INDEPENDENT NITROGEN RECYCLE LOOPS

(71) Applicants: Neil M. Prosser, Lockport, NY (US); Dalar Nazarian, Buffalo, NY (US); Jeremiah J. Rauch, Clarence, NY (US)

(72) Inventors: Neil M. Prosser, Lockport, NY (US); Dalar Nazarian, Buffalo, NY (US); Jeremiah J. Rauch, Clarence, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 763 days.

(21) Appl. No.: 16/802,664

(22) Filed: Feb. 27, 2020

(65) Prior Publication Data

US 2021/0270523 A1 Sep. 2, 2021

(51) Int. Cl.
*F25J 1/02* (2006.01)
*F25J 1/00* (2006.01)

(52) U.S. Cl.
CPC ..... *F25J 1/0037* (2013.01); *F25J 1/0015* (2013.01); *F25J 1/0022* (2013.01); *F25J 1/0045* (2013.01); *F25J 1/0072* (2013.01); *F25J 2270/06* (2013.01)

(58) Field of Classification Search
CPC ..... F25J 1/0201; F25J 1/0202; F25J 1/0015; F25J 1/037; F25J 1/0035; F25J 1/0022; F25J 2270/02; F25J 2270/04; F25J 2270/06; F25J 2245/42
See application file for complete search history.

(56) References Cited

U.S. PATENT DOCUMENTS

| | | | | |
|---|---|---|---|---|
| 3,144,316 | A * | 8/1964 | Stengel | F25J 1/021 62/616 |
| 4,778,497 | A * | 10/1988 | Hanson | F25J 1/0294 62/613 |
| 5,231,835 | A * | 8/1993 | Beddome | F25J 1/0042 62/615 |
| 6,220,053 | B1 * | 4/2001 | Hass, Jr. | F25J 1/0262 62/619 |
| 6,694,774 | B1 | 2/2004 | Rashad et al. | |
| 2010/0236286 | A1 | 9/2010 | Nilsen | |
| 2011/0203312 | A1 | 8/2011 | Jakobsen et al. | |
| 2022/0034584 | A1 * | 2/2022 | Turney | F25J 1/0017 |

FOREIGN PATENT DOCUMENTS

JP H05-280860 A 10/1993

OTHER PUBLICATIONS

Ing. Roland Michely, "Luftzerlegungsanlagen im Parallelbetrieb", Linde Berichte Aus Technik & Wissenschaft, No. 43, Jun. 1, 1978 (Jun. 1, 1978), pp. 39-44, XP001253417, Fig. 4.

* cited by examiner

*Primary Examiner* — Brian M King
(74) *Attorney, Agent, or Firm* — Robert J. Hampsch

(57) ABSTRACT

Liquefier arrangements configured for flexible co-production of both liquid natural gas (LNG) and liquid nitrogen (LIN) are provided. Each liquefier arrangement comprises separate and independent nitrogen recycle circuits or loops, including a warm recycle circuit and a cold recycle circuit with a means for diverting nitrogen refrigerant between the two recycle circuits or loops. The warm recycle circuit includes a booster loaded warm turbine, a warm booster compressor and warm recycle compression whereas the cold recycle circuit includes a booster loaded cold turbine, a cold booster compressor and a separate cold recycle compression.

21 Claims, 4 Drawing Sheets

SYSTEM AND METHOD FOR NATURAL GAS AND NITROGEN LIQUEFACTION WITH INDEPENDENT NITROGEN RECYCLE LOOPS

TECHNICAL FIELD

The present invention relates to liquefaction, and more particularly, to a liquefier arrangement capable of producing liquid natural gas (LNG) and liquid nitrogen (LIN). Still more particularly, the present system and method relates to a liquefier arrangement having independent nitrogen recycle circuits or loops configured for flexible co-production of both LNG and LIN.

BACKGROUND

There are various industrial gas business opportunities where the production of both liquid natural gas (LNG) and liquid nitrogen (LIN) is required. U.S. provisional patent application Ser. No. 62/976,049 filed Feb. 13, 2020, the disclosure of which is incorporated by reference herein, shows examples of liquefier arrangements capable of a liquefaction cycle that co-produces LNG and LIN.

As disclosed in U.S. provisional patent application Ser. No. 62/976,049; liquefier arrangements capable of a liquefaction cycle that co-produce both LNG and LIN require a separate passage in a conventional nitrogen liquefier that is employed to cool and liquefy the natural gas. This modification typically requires changing the brazed aluminum heat exchanger (BAHX) arrangement to allocate one of the passages to cool the natural gas feed and then reallocate a portion of the high pressure gaseous nitrogen feed passages or layers. Since LNG is sufficiently subcooled at about 110 K it is withdrawn from the BAHX at a location corresponding to a temperature somewhat warmer than the cold end of the BAHX where the temperature is about 95 K to 100 K required to liquefy the nitrogen.

The natural gas feed is preferably pre-purified for removal of carbon dioxide and other contaminants as well as removal of minor amounts of moisture prior to entry in the cold box. Other potential contaminants may include $H_2S$, mercaptans, mercury and mercury compounds which also must be removed or reduced to a satisfactory level. Usually, heavier hydrocarbons are sufficiently extracted in NGL facilities prior to supply. If this is not the case, a significant modification in the liquefier design would be required in order to capture and remove the heavier hydrocarbons at an intermediate temperature. Also, if the feed natural gas is at a low pressure, the liquefaction process may optionally require pre-compression of the natural gas feed, preferably to a pressure of about 450 psia to enable the use of a modified nitrogen liquefier design. If the pressure of the natural gas feed is below about 450 psia, the temperature difference in the natural gas condensing zone of the heat exchanger may exceed the allowable limits for many BAHX designs. Alternatively, if the feed natural gas is supplied at a lower pressure, the liquefier design would have to be changed so that at least the condensing portion of the heat exchanger is of a different design, for example, a stainless steel brazed heat exchanger or a stainless steel spiral wound heat exchanger. Thus, to avoid the much more expensive heat exchangers and to achieve improved efficiencies, natural gas pre-compression is preferred. The further compressed natural gas feed would optionally be cooled in an aftercooler to remove the heat of compression.

During liquefaction of a high pressure natural gas feed, the refrigeration demand of the warm turbine is greatly increased. This increased refrigeration demand is because natural gas liquefaction or pseudo-liquefaction is now taking place at a temperature above the exhaust temperature of the warm turbine. As a result, the warm turbine is larger and passes significantly more flow. The cold turbine refrigeration primarily is providing refrigeration for liquefaction or pseudo-liquefaction of the nitrogen while the warm turbine refrigeration primarily provides refrigeration for natural gas liquefaction or pseudo-liquefaction. This means that independent variation in the LNG demand and the LIN demand likely results in independent variation of the demand for refrigeration from each turbine and the optimal warm turbine to cold turbine flow ratio will vary significantly, depending on the output demand for LNG and LIN. A smaller portion of the cold turbine refrigeration load provides for subcooling of liquid natural gas and a smaller portion of the warm turbine refrigeration load removes superheat from nitrogen. The prior art liquefier arrangement capable of a liquefaction cycle that co-produces both LNG and LIN disclosed in U.S. provisional patent application Ser. No. 62/976,049 suffers from a disadvantage of limited ability to adjust the warm turbine to cold turbine flow ratio to achieve the optimal ratio when demand for LNG and LIN changes. Further, it will exhibit a notable efficiency penalty to accomplish even the limited warm turbine to cold turbine flow ratio changes.

It is expected that varying demands of LNG and LIN in co-production natural gas liquefaction plants will be important. For example, small peak shaver LNG plants are located strategically on natural gas pipelines and configured to store natural gas as LNG during the months when it is less expensive, and to return the natural gas to the pipeline when price and demand peaks, most often during cold winter weather and hot summer weather. These facilities produce LNG at maximum levels for part of the year and produce little or no LNG for the rest of the year. Co-production of LIN in such plants may be beneficial in strategic locations where demand for merchant LIN or back-up LIN is required. Of course, the potential for variation in merchant LIN demand and back-up LIN demand near a given LNG location can lead to wide changes in demand for LIN production.

Nitrogen liquefiers are typically capable of efficient turndown over a very broad range. Turndown to about 20% of capacity is achievable at reasonably good efficiency. Turndown is accomplished naturally by keeping the turbine nozzles unchanged or nearly unchanged. As the liquefier is turned down, the feed nitrogen flow is reduced and the pressure levels within the liquefier fall commensurately. As a result, the volumetric flows through the turbines, their respective boosters, and the recycle compressor remain essentially unchanged at their design rates. The pressure ratios across the machines also remain nearly unchanged. So, while the machines become more unloaded, they each continue to operate essentially at their ideal design point. This means that the aerodynamic efficiencies of the rotating machines remain unchanged. The feed gas compressor is an exception to this, as it must be turned down with guide vanes or a suction throttle valve due to its lower flow and discharge pressure, with a constant supply pressure. The power demand of the recycle compressor is much larger than that of the feed gas compressor, though. So, it doesn't have a very large effect. Other than this, the only penalties for turndown are those associated with the mechanical and motor losses of the rotating machinery (which increase as a proportion of the total power consumption at turndown), and a significant thermodynamic penalty for the lower pressure liquefaction of nitrogen. This thermodynamic penalty occurs because at lower pressures, and particularly below its critical point pressure, the liquefaction of nitrogen results in a more thermodynamically irreversible temperature profile. The larger temperature invariant zones at lower nitrogen liquefaction pressures result in both tight pinch deltaT (ΔT) values and large deltaT (ΔT) values.

What is needed, therefore is a flexible liquefier capable of co-production of LNG and LIN capable of turndown as well as of adjusting the warm turbine to cold turbine flow ratio to achieve the optimal ratio as demand for LNG and LIN products change.

SUMMARY OF THE INVENTION

The present invention may be broadly characterized as a nitrogen based, flexible liquefaction system for co-production of liquid nitrogen and liquid natural gas that comprises: (i) a primary recycle circuit configured to receive all or a portion of a gaseous nitrogen feed stream and produce a primary nitrogen liquefaction stream; (ii) a secondary closed-loop recycle circuit configured to recirculate a nitrogen refrigerant to provide refrigeration for the liquefaction system; (iii) a diversion circuit having one or more valves configured to direct a portion of the gaseous nitrogen stream from the primary recycle circuit to the secondary recycle circuit; and (iv) a multi-pass brazed aluminum heat exchanger (BAHX) configured to liquefy a portion of the primary nitrogen liquefaction stream, recycle portions of the primary nitrogen liquefaction stream and the nitrogen refrigerant in the secondary closed-loop recycle circuit, and to liquefy a natural gas feed stream in separate heat exchange passages.

The primary recycle circuit generally includes a primary recycle compressor, a primary booster compressor and a booster loaded primary turbine arranged or configured to: (a) compress the gaseous nitrogen feed stream and a primary gaseous nitrogen recycle stream in the primary recycle compressor to produce a gaseous nitrogen effluent stream; (b) further compress all or a portion of the effluent stream in the primary booster compressor to form the primary nitrogen liquefaction stream; (c) cool the primary nitrogen liquefaction stream in a first heat exchange passage in the BAHX; (d) expand a first portion of the cooled primary nitrogen liquefaction stream extracted at a primary intermediate location of the first heat exchange passage in the booster loaded primary turbine to produce a primary turbine exhaust; and (e) warm the primary turbine exhaust in a second heat exchange passage in the multi-pass BAHX to produce the primary gaseous nitrogen recycle stream. The secondary recycle circuit includes a secondary recycle compressor, a secondary booster compressor and a booster loaded secondary turbine configured to: (f) receive a secondary recycle stream; (g) compress the secondary recycle stream in the secondary recycle compressor; (h) further compress the secondary recycle stream in the secondary booster compressor; (i) cool the further compressed secondary recycle stream in a third heat exchange passage of the multi-pass BAHX; (j) expand the cooled, further compressed secondary recycle stream in the booster loaded secondary turbine to produce a secondary turbine exhaust; (k) warm the secondary turbine exhaust in a fourth heat exchange passage of the multi-BAHX; and (l) recycle the resulting warmed stream as the secondary recycle stream to the secondary recycle compressor.

The present invention may also be broadly characterized as a method of liquefaction to co-produce liquid nitrogen and liquid natural gas, the present method comprising the steps of: (i) receiving a gaseous nitrogen feed stream in a primary recycle circuit; (ii) compressing the gaseous nitrogen feed stream and a primary gaseous nitrogen recycle stream in a primary recycle compressor to produce a gaseous nitrogen effluent stream; (iii) further compressing all or a portion of the effluent stream in a primary booster compressor to form a primary nitrogen liquefaction stream; (iv) cooling the primary nitrogen liquefaction stream in a first heat exchange passage in a multi-pass BAHX; (v) expanding a first portion of the cooled primary nitrogen liquefaction stream extracted at an intermediate location of the first heat exchange passage in a booster loaded primary turbine to produce a primary turbine exhaust; (vi) warming the primary turbine exhaust in a second heat exchange passage in the multi-pass BAHX to produce the primary gaseous nitrogen recycle stream; (vii) receiving a secondary recycle stream in a secondary recycle circuit; (viii) compressing the secondary recycle stream in a secondary recycle compressor; (ix) further compressing the secondary recycle stream in a secondary booster compressor; (x) cooling the further compressed secondary recycle stream in a third heat exchange passage of the multi-pass BAHX; (xi) expanding the cooled, further compressed secondary recycle stream in a booster loaded secondary turbine to produce a secondary turbine exhaust; (xii) warming the secondary turbine exhaust in a fourth heat exchange passage of the multi-pass BAHX; (xiii) recycling the resulting warmed stream as the secondary recycle stream to the secondary recycle compressor; (xiv) diverting a portion of the gaseous nitrogen effluent stream from the primary recycle circuit to the secondary recycle circuit; (xv) subcooling the primary nitrogen liquefaction stream to produce the subcooled liquid nitrogen stream; (xvi) liquefying a natural gas feed stream in a sixth heat exchange passage of the multi-pass BAHX against a first portion of the subcooled liquid nitrogen stream in a fifth heat exchange passage of the multi-pass BAHX to produce the liquid natural gas; and (xvii) taking a second portion of the subcooled liquid nitrogen stream as the liquid nitrogen.

In some embodiments of the disclosed liquefaction systems or methods, the primary recycle circuit may be what is commonly referred to as a cold recycle circuit and the secondary recycle circuit is referred to as a warm recycle circuit. In such embodiments the primary recycle compressor is a cold recycle compressor, the primary booster compressor is a cold booster compressor, the booster loaded primary turbine is a booster loaded cold turbine, the primary gaseous nitrogen recycle stream is a cold gaseous nitrogen recycle stream; and the primary turbine exhaust is a cold turbine exhaust. Similarly, the secondary recycle compressor is a warm recycle compressor, the secondary booster compressor is a warm booster compressor, the booster loaded secondary turbine is a booster loaded warm turbine, the secondary gaseous nitrogen recycle stream is a warm gaseous nitrogen recycle stream; and the secondary turbine exhaust is a warm turbine exhaust.

In other embodiments the primary recycle circuit is referred to as the warm recycle circuit and the secondary recycle circuit is referred to as the cold recycle circuit. In these embodiments the primary recycle compressor is the warm recycle compressor, the primary booster compressor is the warm booster compressor, the booster loaded primary turbine is the booster loaded warm turbine, the primary gaseous nitrogen recycle stream is the warm gaseous nitrogen recycle stream; and the primary turbine exhaust is the warm turbine exhaust. The secondary recycle compressor is then the cold recycle compressor, the secondary booster compressor is the cold booster compressor, the booster loaded secondary turbine is the booster loaded cold turbine, the secondary gaseous nitrogen recycle stream is the cold gaseous nitrogen recycle stream; and the secondary turbine exhaust is the cold turbine exhaust.

All embodiments may also include a subcooler configured to subcool a portion of the primary nitrogen liquefaction stream to produce a subcooled liquid nitrogen stream. A first portion of the subcooled liquid nitrogen stream is used to liquefy the natural gas feed stream in separate passages of the multi-pass BAHX while a second portion of the subcooled liquid nitrogen stream is taken as the liquid nitrogen product.

All embodiments of the liquefaction system and method may also have a nitrogen feed compressor configured to compress the gaseous nitrogen feed stream upstream of the primary recycle circuit as well as a natural gas feed compressor configured to compress the incoming natural gas feed stream. A liquid turbine may also be optionally included and configured to expand a portion of the liquid nitrogen exiting the multi-pass BAHX. Finally, some embodiments of the liquefaction system and method may also include a vent circuit configured to vent or extract a portion of the nitrogen refrigerant or secondary recycle stream from the secondary recycle circuit.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawings in which:

DETAILED DESCRIPTION

Turning now to the drawings, there are shown four different embodiments of the present system and method for the flexible liquefaction of both LNG and LIN. In each of the illustrated embodiments, a common and key feature is the separate and independent recycle circuits or loops for the cold turbine and for the warm turbine. The cold recycle circuit and the warm recycle circuit are each driven by a separate recycle compressor. In practice, the recycle compressor(s) may be comprised of a single multi-stage, intercooled compressor with a single motor drive where the some of the stages and intercoolers of the multi-stage compressor are dedicated to the warm recycle compressor in the warm recycle circuit and other compression stages and intercoolers of the multi-stage compressor are dedicated to the cold recycle compressor in the cold recycle circuit. Such configuration provides capital cost savings with little or no operational or efficiency penalty. Alternatively, separate compressors may be employed, one configured to be used in the warm recycle compressor loop and another compressor configured to be used in the cold recycle compressor loop.

Figure 1:
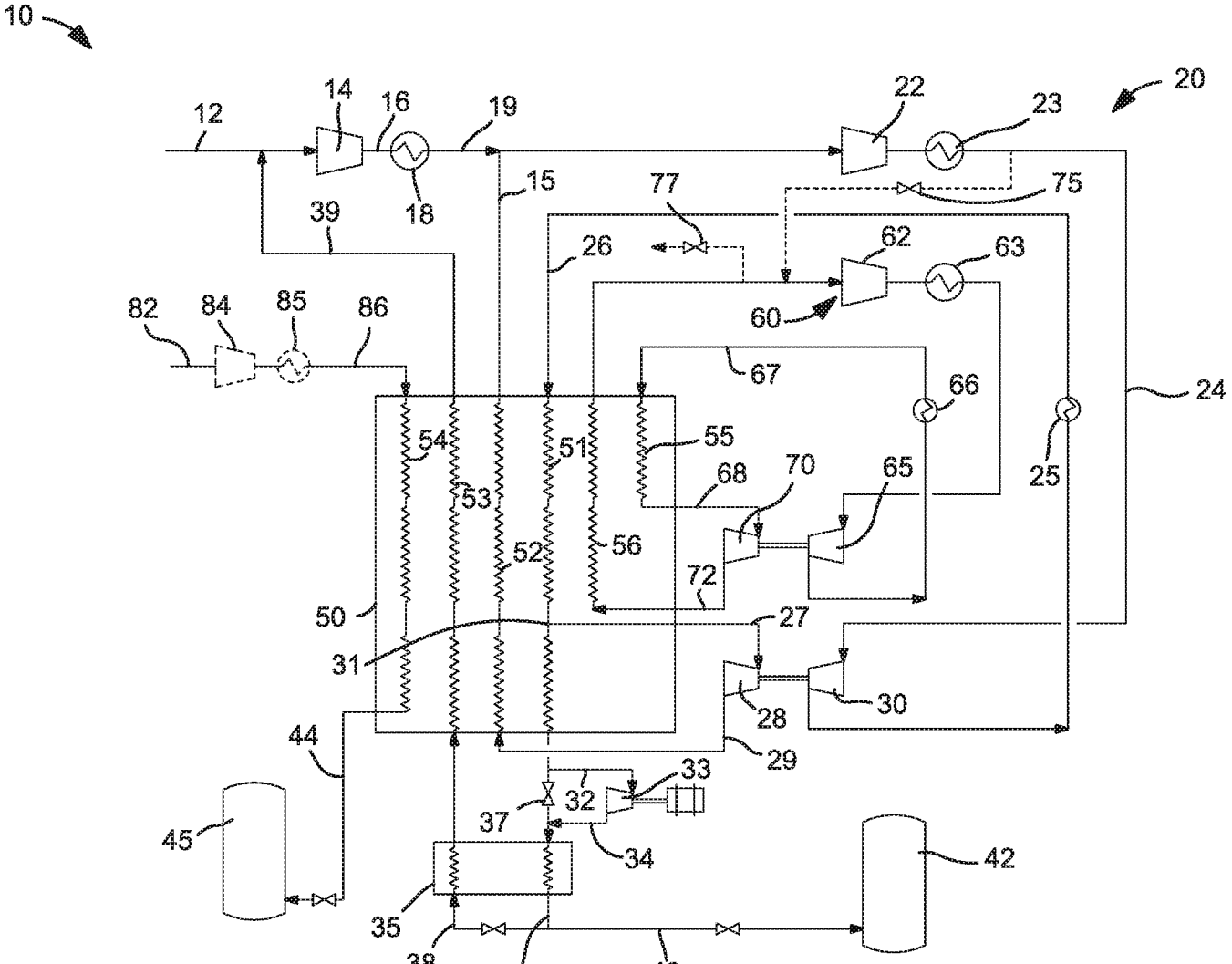
FIG. 1 is a schematic diagram of a liquefier capable of co-producing LNG and LIN in accordance with an embodiment of the present system and method with cold loop nitrogen liquefaction.

Turning now to FIG. 1, there is shown a first embodiment of the present system and method with cold loop nitrogen liquefaction. As seen therein, a feed stream 12 of gaseous nitrogen and a natural gas feed stream 82 are introduced into the liquefier 10. The nitrogen feed is preferably compressed in a feed gas compressor 14 and the compressed nitrogen feed stream 16 is then cooled in aftercooler 18. The cooled compressed nitrogen feed stream 19 is directed to a primary recycle circuit shown as a cold recycle circuit 20 where the cooled compressed nitrogen feed stream 19 is further compressed in a cold recycle compressor 22 and cooled in aftercooler 23. A portion of the effluent from the cold recycle compressor 22 may be diverted to warm recycle circuit 60 while the majority remainder of the further compressed nitrogen feed 24 is directed to a cold booster compressor 30 where the stream is still further compressed and subsequently aftercooled in aftercooler 25 to produce a primary nitrogen liquefaction stream 26.

The primary nitrogen liquefaction stream 26 is directed to a first heat exchange passage 51 in a brazed aluminum heat exchanger (BAHX) 50 for cooling to temperatures suitable for nitrogen liquefaction. A first portion 27 of the primary nitrogen liquefaction stream in the first passage 51 of the BAHX 50 is extracted at an intermediate location of the first heat exchange passage 51 and directed to the booster loaded cold turbine 28 where the first extracted portion 27 is expanded to produce a cold turbine exhaust 29. The cold turbine exhaust 29 is then directed to the cold end of a second heat exchange passage 52 in the BAHX 50. The cold turbine exhaust 29 is then warmed in the BAHX 50 and the warmed exhaust 15 is recycled to the compressed nitrogen feed stream 19.

A second portion 31 of the primary nitrogen liquefaction stream continues through the BAHX 50 to produce a liquid nitrogen stream 32. The liquid nitrogen stream 32 is optionally diverted to a generator loaded liquid turbine 33 where it is expanded to produce a liquid turbine exhaust stream 34. The liquid turbine exhaust stream 34 is directed to subcooler 35 configured to produce a subcooled liquid nitrogen stream 36. The use of a generator loaded liquid turbine 33 shown in in the drawings is optional. Use of the liquid turbine likely depends on the power savings provided relative to the cost of electricity at a given installation site. In lieu of using the liquid turbine 33, the liquid nitrogen stream 32 may proceed directly to subcooler 35 via throttle valve 37, where it is let down in pressure.

A first portion 38 of the subcooled liquid nitrogen stream, after being let down in pressure, is routed to the subcooler 35, where it is at least partially vaporized, and then to a third heat exchange passage 53 of BAHX 50 to provide the requisite cooling for the nitrogen and natural gas streams. The resulting recycle stream 39 exiting the warm end of the third heat exchange passage 53 is recycled to the gaseous nitrogen feed stream 12. A second portion of the subcooled liquid nitrogen stream is the liquid nitrogen product stream 40 preferably directed to LIN product storage tank 42.

The purified, natural gas feed stream 82 is received from a source of natural gas (not shown) and is optionally compressed in natural gas compressor 84 and optionally cooled in aftercooler 85. The conditioned natural gas feed 86 is then directed to a fourth heat exchange passage 54 in BAHX 50 where it is cooled to temperatures suitable for liquefaction of natural gas. The LNG stream 44 existing fourth heat exchange passage 54 in BAHX 50 is sent to LNG storage tank 45.

The secondary recycle circuit or the warm recycle circuit 60 operates as a generally closed-loop refrigeration circuit using nitrogen streams within the warm recycle circuit 60 as the refrigerant. The recirculating nitrogen refrigerant is compressed in warm recycle compressor 62. The further compressed warm loop nitrogen stream 64 is still further compressed in the warm booster compressor 65. The nitrogen refrigerant that is compressed in warm recycle compressor 65 and the warm booster compressor may be subsequently aftercooled in aftercoolers 63, 66 disposed downstream of the respective compressors 62, 65 to remove the heat of compression.

The still further compressed refrigerant stream 67 is directed to a fifth heat exchange passage 55 in the BAHX 50 where it is cooled. The cooled refrigerant stream 68 is extracted from the fifth heat exchange passage 55 of BAHX 50 at an intermediate location and directed to the booster loaded warm turbine 70 where it is expanded. The exhaust stream 72 from the warm turbine 70 is introduced to a sixth heat exchange passage 56 of BAHX 50 to provide additional refrigeration to the liquefier. The warmed exhaust stream 74 exits the warm end of the BAHX 50 and is recycled to the warm recycle compressor 62.

As indicated above and described in more detail below, a portion of the effluent of the further compressed nitrogen gas from the cold recycle circuit 20 may be diverted via opening valve 75 to warm recycle circuit 60 and added as additional refrigerant is needed. Likewise, a portion of the nitrogen refrigerant in the warm recycle circuit 60 may be vented or extracted from the warm recycle circuit via valve 77 when less refrigerant is needed.

In the liquefier arrangement of FIG. 1 the secondary recycle circuit is a warm recycle circuit 60 which contains the booster loaded warm turbine 70 is a closed-loop circuit while the cold recycle circuit 20, which includes the booster loaded cold turbine 28 is supplied with gaseous nitrogen from the feed gas compressor 14 so that liquid nitrogen product stream 40 is eventually withdrawn from cold recycle circuit 20.

Configuring the liquefier arrangement with independent warm recycle circuit 60 and cold recycle circuit 20 provide a similar range of efficient turndown as a conventional nitrogen liquefier. The cold recycle circuit 20 naturally falls in pressure as the nitrogen product flow is decreased (i.e. lower LIN demand) while turbomachines in the cold recycle circuit 20 remain at or near optimal efficiencies. For the warm recycle circuit 60, as the LNG product rate is reduced (i.e. lower LNG demand), the pressure level in the warm recycle circuit 60 is preferably decreased, preferably by venting of some of the nitrogen refrigerant via valve 77. This technique enables the turbomachines in the warm recycle circuit to continue to operate at or near optimal efficiencies.

Likewise, for an increase in production of the LNG (i.e. product turn-up), nitrogen refrigerant must be added to the circuit by diverting a portion of nitrogen from the higher pressure cold recycle circuit 20 to the lower pressure warm recycle circuit 60 via valve 75. There may in fact, be multiple locations from which to withdraw nitrogen flow from the cold recycle loop and add nitrogen flow to the warm recycle circuit to load up its capacity, including perhaps inter-stage recycle compressor locations. The preferred location of such nitrogen transfer is very much dependent on the relative pressure levels between the cold recycle circuit and the warm recycle circuit which can differ dramatically for different installations or operational modes of the present liquefier. In any event, a small continuous flow of nitrogen from the cold recycle circuit to the warm recycle circuit is likely necessary even during steady state operation to balance the unrecovered seal losses in the turbomachines in the warm recycle circuit.

In order to reduce the capital cost of the liquefier, it is often desirable to reduce the number of compressor stages in the recycle compressor. For example, if the single multi-stage compressor machine uses only four stages, two of the compression stages would be dedicated to the cold recycle circuit compressor function and the other two compression stages would be dedicated to the warm recycle circuit compressor function. In such arrangement, the single multi-stage compressor machine would be characterized as both the primary recycle compressor and the secondary recycle compressor and the capital cost of the co-product LNG and LIN liquefier would approach that of a conventional nitrogen liquefier, which typically has about four recycle compressor stages in the recycle compressor. By bifurcating the compression stages between the cold recycle compressor and the warm recycle compressor, the corresponding pressure ratios across the cold turbine and the warm turbine will be reduced from that of a conventional nitrogen liquefier to correspond to the capability of only two stages of recycle compression in each loop. A turbine pressure ratio of about 7.0 should be achievable for the warm turbine and a turbine pressure ratio of about 6.0 for the cold turbine. Such reduced pressure ratios should not penalize efficiency relative to a conventional nitrogen liquefier design where each turbine operates at a pressure ratio of about 8.5 to about 9.0. It should be noted that combined service compressors are by no means limited to four stages. The savings in operating cost that may result from additional stages may warrant the added cost.

In order to effectively subcool the product LIN, it must be produced sufficiently cold from the liquefier BAHX. This means that the cold turbine outlet pressure must not exceed about 85 psia to about 90 psia. Otherwise, the saturated vapor or slightly two phase exhaust is too warm to satisfactorily cool the cold end nitrogen. This points to a minor problem of the liquefier arrangement or embodiment shown in FIG. 1, namely if the recycle circuit pressure ratios are reduced because of the use of too few compression stages. In other words, if the recycle circuit pressure ratios are reduced, the corresponding lower pressure ratio of the cold turbine could result in the liquefying nitrogen stream pressure being undesirably low, which leads to an efficiency penalty.

Figure 2:
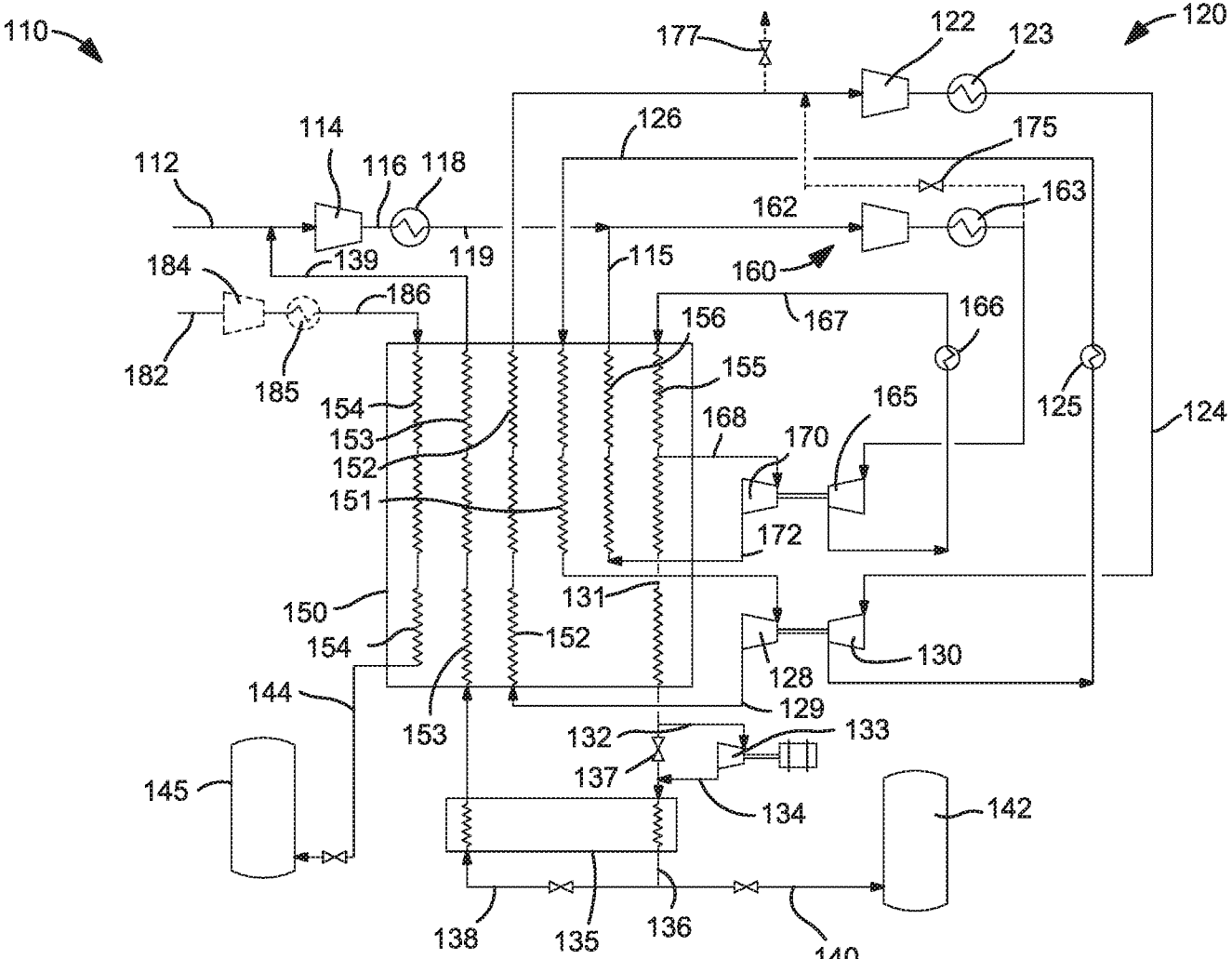
FIG. 2 is a schematic diagram of a liquefier capable of co-producing LNG and LIN in accordance with another embodiment of the present system and method with warm loop nitrogen liquefaction.

This problem may be solved by using the liquefier arrangement 110 or embodiment shown in FIG. 2. where the feed nitrogen stream is directed to the warm recycle compressor and warm recycle circuit rather than the cold recycle compressor and cold recycle circuit as shown in FIG. 1. The primary nitrogen liquefaction stream is delivered from the warm booster rather than the cold booster.

Turning now to FIG. 2, there is shown a second embodiment of the present system and method with warm loop nitrogen liquefaction. As seen therein, a feed stream 112 of gaseous nitrogen and a natural gas feed stream 182 are introduced into the liquefier 110. The nitrogen feed stream 112 is preferably compressed in a feed gas compressor 114 and the compressed nitrogen feed stream 116 is then cooled in aftercooler 118. The cooled compressed nitrogen feed stream 119 is directed to a warm recycle circuit 160, which is configured as the primary recycle circuit, and where the cooled compressed nitrogen feed stream 119 is further compressed in a warm recycle compressor 162 and cooled in aftercooler 163. A portion of the effluent from the warm recycle compressor 162 may be diverted to the secondary recycle circuit which is the cold recycle circuit 120 while the majority remainder of the further compressed nitrogen feed 164 is directed to a warm booster compressor 165 where the stream is still further compressed and subsequently aftercooled in aftercooler 66 to produce a primary nitrogen liquefaction stream 167.

The primary nitrogen liquefaction stream 167 is directed to a first heat exchange passage 155 in a brazed aluminum heat exchanger (BAHX) 150 for cooling to temperatures suitable for nitrogen liquefaction. A first portion 168 of the primary nitrogen liquefaction stream in the first passage 155 of the BAHX 150 is extracted at an intermediate location of the first heat exchange passage 155 and directed to the booster loaded warm turbine 170 where the first extracted portion 168 is expanded to produce a warm turbine exhaust 172. The warm turbine exhaust 172 is then directed to the cold end of a second heat exchange passage 156 in the BAHX 150. The warm turbine exhaust 172 is then warmed in the BAHX 150 and the warmed exhaust 115 is recycled to the compressed nitrogen feed stream 119.

A second portion 131 of the primary nitrogen liquefaction stream continues through the BAHX 150 to produce a liquid nitrogen stream 132. The liquid nitrogen stream 132 is optionally diverted to a generator loaded liquid turbine 133 where it is expanded to produce a liquid turbine exhaust stream 134. The liquid turbine exhaust stream 134 is directed to subcooler 135 configured to produce a subcooled liquid nitrogen stream 136. The use of the generator loaded liquid turbine 133 shown in in the drawings is optional. Use of the liquid turbine likely depends on the power savings that the liquid turbine provides relative to the cost of electricity at a given installation site. In lieu of using the generator loaded liquid turbine 133, the liquid nitrogen stream 132 may proceed directly to subcooler 135 via throttle valve 137.

A first portion 138 of the subcooled liquid nitrogen stream, after being let down in pressure, is routed to the subcooler 135, where it is at least partially vaporized, and then to a third heat exchange passage 153 of the BAHX 150 to provide the requisite cooling for the nitrogen and natural gas streams. The resulting recycle stream 139 exiting the warm end of the third heat exchange passage 153 is recycled to the gaseous nitrogen feed stream 112. A second portion of the subcooled liquid nitrogen stream is the liquid nitrogen product stream 140 preferably directed to LIN product storage tank 142.

The purified, natural gas feed stream 182 is received from a source of natural gas (not shown) and is optionally compressed in natural gas compressor 184 and optionally cooled in aftercooler 185. The conditioned natural gas feed 186 is then directed to a fourth heat exchange passage 154 in the BAHX 150 where it is cooled to temperatures suitable for liquefaction of natural gas. The natural gas stream existing the fourth heat exchange passage 154 in the BAHX 150 is LNG stream 144 that is sent to LNG storage tank 145.

The cold recycle circuit 120 or circuit operates as a generally closed-loop refrigeration circuit using nitrogen streams within the cold recycle circuit 120 as the refrigerant. The recirculating nitrogen refrigerant is compressed in cold recycle compressor 122. The further compressed cold loop nitrogen stream 124 is still further compressed in the cold booster compressor 130. The nitrogen refrigerant that is compressed in cold recycle compressor 122 and the cold booster compressor 130 may be subsequently aftercooled in one or more aftercoolers 123,125 disposed downstream of the respective compressors 122,130 to remove the heat of compression.

The still further compressed refrigerant stream 126 is directed to a fifth heat exchange passage 151 in the BAHX 150 where it is cooled. The cooled refrigerant stream 126 is extracted from the fifth heat exchange passage 151 of the BAHX 150 at an intermediate location and directed to the booster loaded cold turbine 128 where it is expanded. The exhaust stream 129 from the cold turbine 128 is introduced to a sixth heat exchange passage 152 of the BAHX 150 to provide additional refrigeration to the liquefier. The warmed exhaust stream exits the warm end of the BAHX 150 and is recycled to the cold recycle compressor 122.

As indicated above and described in more detail below, a portion of the effluent of the further compressed nitrogen gas from the warm recycle circuit 160 may be diverted via opening valve 175 to cold recycle circuit 120 and added as additional refrigerant is needed. Likewise, a portion of the nitrogen refrigerant in the cold recycle circuit 120 may be vented or extracted from the cold recycle circuit 120 via valve 177 when less refrigerant is needed.

In the liquefier arrangement 110 of FIG. 2 the cold recycle circuit 120 which contains the booster loaded cold turbine 128 is a closed-loop circuit while the warm recycle circuit 160, which includes the booster loaded warm turbine 170 is supplied with gaseous nitrogen from the feed gas compressor 114 so that liquid nitrogen product stream 140 is eventually withdrawn from the warm recycle circuit 160.

In the embodiment of FIG. 2, the pressure of the primary nitrogen liquefaction stream is set by the head pressure of the warm recycle circuit and there is very little efficiency penalty for operating the cold turbine at a discharge pressure of about 85 psia to about 90 psia at design capacity. Rather than liquefying the nitrogen stream at the lower pressure of the cold recycle circuit, the warm turbine circuit can be operated at a higher pressure such that the liquefying product pressure can be raised to the desired pressure level. Although this means that the warm turbine discharge pressure is higher when there are only two warm recycle compressor stages, this is not a problem as it does not affect the temperature level of the warm turbine, as the temperature is well above the saturated vapor temperature of the exhaust stream. Furthermore, the higher operating temperature of the warm turbine produces more refrigeration per unit flow than the cold turbine so that it naturally operates at a higher pressure ratio. The greater power generation of the warm turbine means that the warm booster naturally generates a larger pressure rise, thus increasing the warm turbine pressure ratio relative to that of the cold turbine pressure ratio. This, in turn means that the added flow of the product nitrogen in the warm turbine will not reduce the pressure ratio as much as it does for the cold turbine when cold recycle circuit includes the primary nitrogen liquefaction stream, as in FIG. 1.

The lower pressure ratios of the turbine loops described in the reduced recycle compressor stage scenario in FIG. 2 mean that the temperature change across each of the turbines are also reduced. As a result, the temperature of the warm turbine exhaust may be higher than the return temperature of warming nitrogen that combines with it prior to passing into the next level of heat exchange. To address this problem, an alternate configuration of a liquefier capable of co-producing LNG and LIN with warm loop nitrogen liquefaction is shown in FIG. 3.

Figure 3:
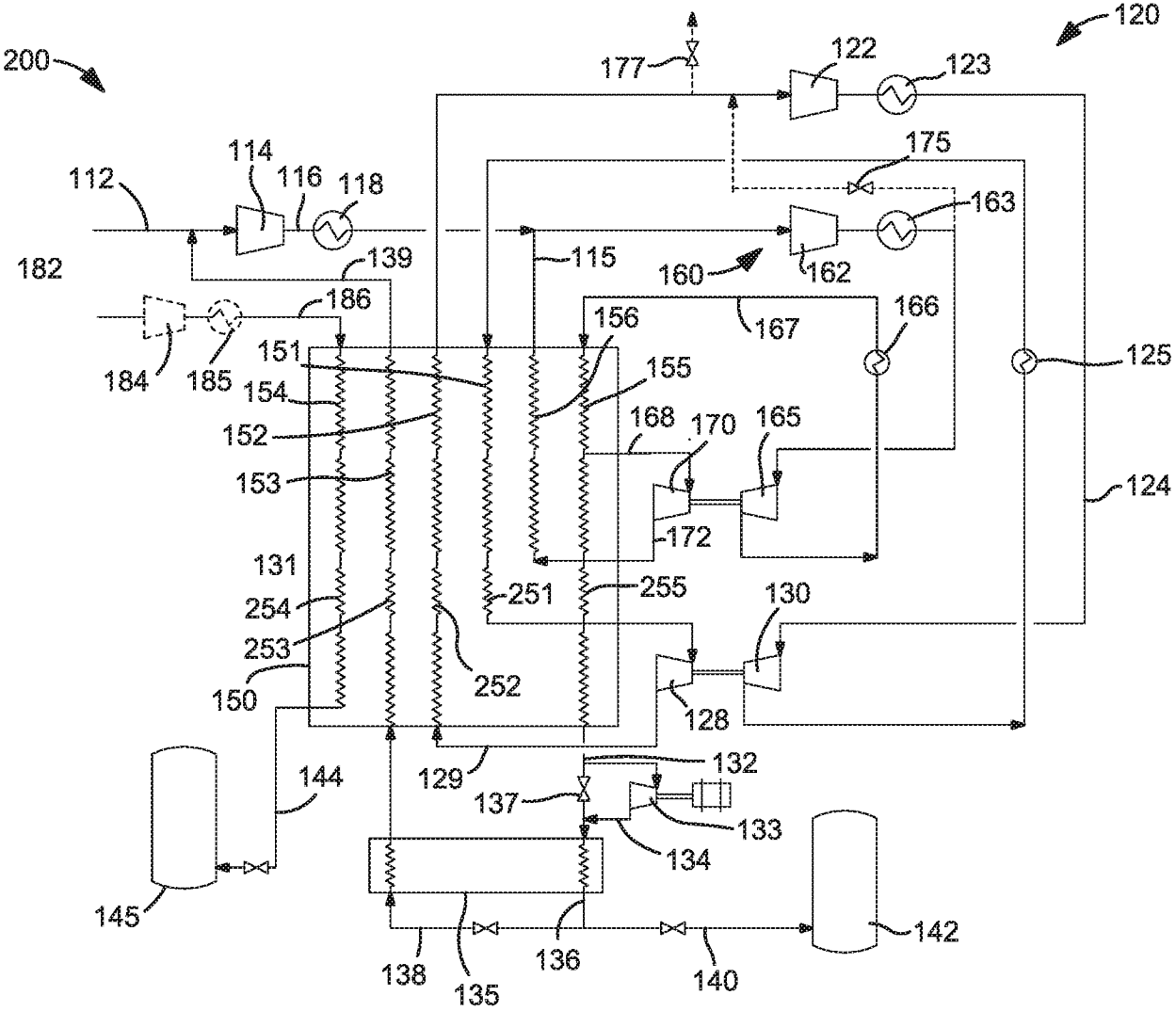
FIG. 3 is a schematic diagram of a liquefier capable of co-producing LNG and LIN in accordance with yet another embodiment of the present system and method that is a variant of the embodiment shown in FIG. 2.

The embodiment of FIG. 3 is in many ways the same or similar to the embodiment of FIG. 2 except that the heat exchange passages in the BAHX are extended to include an additional zones of heat exchange. As many of the components and streams in the embodiment of FIG. 3 are the same as in the embodiment of FIG. 2, the drawings use the same reference numerals and the descriptions thereof will not be repeated. These additional extended zones 251, 252, 253, 254, 255 are added between the warm turbine exhaust and the cold turbine feed. This liquefier arrangement 200 allows the further warming of the return streams such that they approximately match the warm turbine exhaust temperature. The efficiency loss of mixing a warm turbine stream that is significantly warmer than the return stream is thus avoided. Note that while the embodiment of FIG. 3 is a variation of FIG. 2, a similar variation could be applied to the embodiments illustrated in FIG. 1 or FIG. 4.

Figure 4:
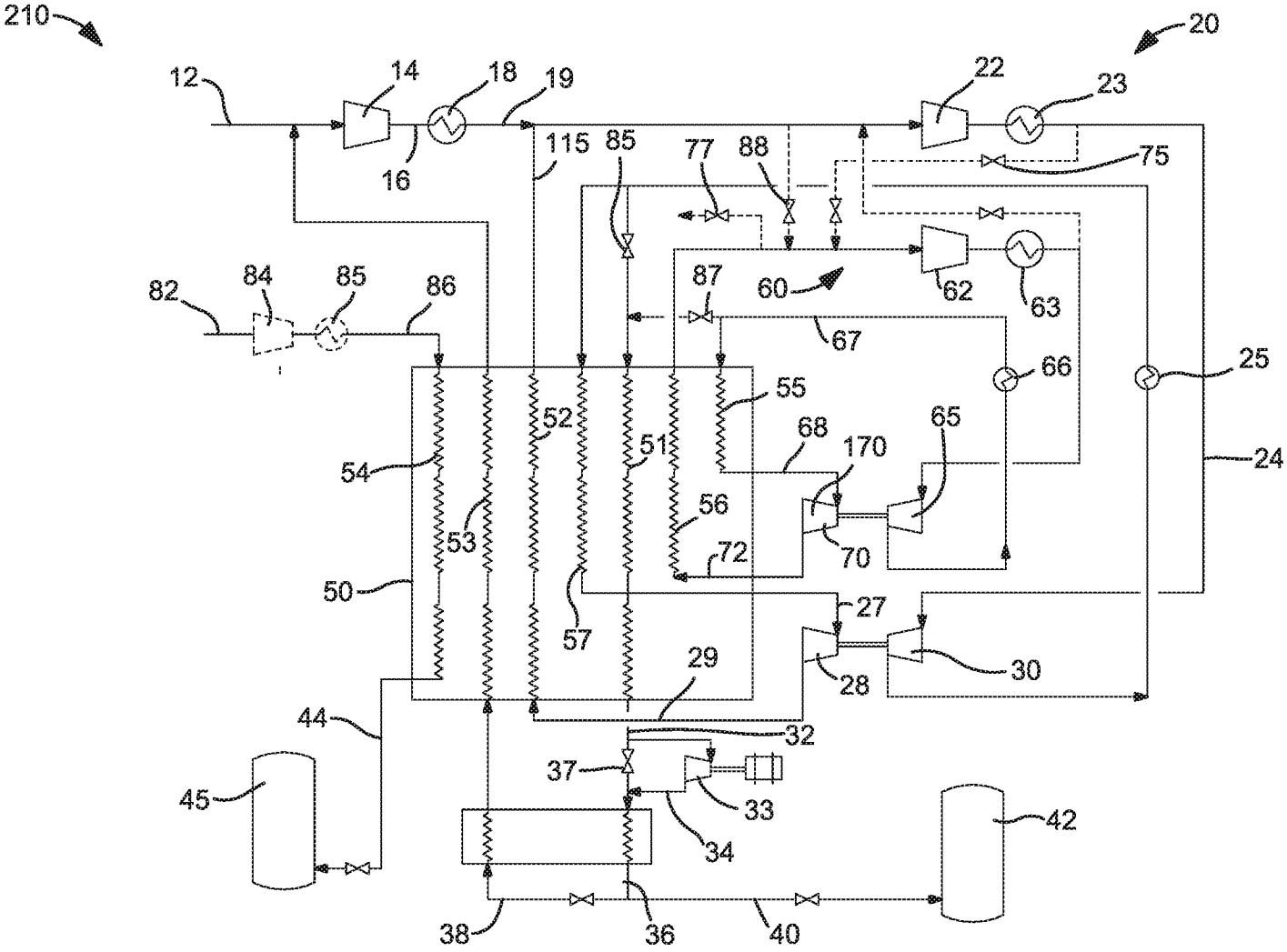
FIG. 4 is a schematic diagram of a liquefier capable of co-producing LNG and LIN in accordance with still another embodiment of the present system and method with nitrogen liquefaction selectable between cold loop liquefaction and warm loop liquefaction.

FIG. 4 shows a still further embodiment of a liquefier arrangement configured for flexible co-production of both LNG and LIN. The embodiment of FIG. 4 is in many ways the same or similar to the above described embodiments. As many of the components and streams in the embodiment of FIG. 4 are the same as in the previously described embodiments, the respective drawings use the same or similar reference numerals and the descriptions of the common components will not be repeated. Rather, the following description will focus on the differences present in the embodiment of FIG. 4 over the other embodiments.

Keeping in mind that the thermodynamic efficiency of the liquefier is best when nitrogen is liquefied at the highest pressure possible, the embodiment of FIG. 4 provides a system and method for achieving that optimal thermodynamic efficiency in high LNG production operating modes and low LNG production operating mode. Specifically, FIG. 4 shows a liquefier arrangement where the highest pressure source for the liquefying nitrogen can be selected from the cold recycle circuit or the warm recycle circuit in order to best optimize the liquefier efficiency in different operating modes.

FIG. 2 and FIG. 3 show embodiments that enable nitrogen liquefaction at the highest possible pressure in a reduced turbine and recycle compressor pressure ratio design, when operating at its design point. However, if it is desired to reduce the LNG production considerably without reducing the LIN rate, the pressure of the warm turbine feed may fall below that of the cold turbine feed. In this case it would be better to have the embodiment of FIG. 1 where the liquefying nitrogen emanates from the cold turbine feed rather than the warm turbine feed.

As seen therein, the liquefying nitrogen stream occupies a separate and dedicated cooling passage in the BAHX. The feed source to this separate and dedicated cooling passage may be selected depending on the operating scenario of the liquefier 210. For example, in design mode operation like that described above with reference to FIG. 2 and FIG. 3 where the warm turbine feed pressure is the highest, the system depicted in FIG. 4 has a switching circuit having several valves 85,87,88 that would operate with valves 87 and 88 open and valve 85 closed. In mode, the compressed feed nitrogen stream is directed to the warm recycle circuit and the liquefying nitrogen is drawn into the separate and dedicated cooling passage in the BAHX from the warm recycle circuit.

On the other hand, in operating modes where the LNG production rate is turned down such that the warm turbine feed pressure is below that of the cold turbine, valve 85 would be open and the valve 87 closed. In this alternate mode the compressed feed nitrogen stream is directed to the cold recycle circuit and the liquefying nitrogen is drawn into the separate and dedicated cooling passage in the BAHX from the cold recycle circuit. In other words, in this embodiment the primary recycle circuit and the secondary recycle circuit can be switched depending on the desired operating mode. between the arrangement. In one operating mode, the primary recycle circuit is the warm recycle circuit and the secondary recycle circuit is the cold recycle circuit while in a second operating mode the primary recycle circuit is the cold recycle circuit and the secondary recycle circuit is the warm recycle circuit. In FIG. 4, it should be noted that the main feed from stream 19 is directly fed to cold recycle circuit 20, with flow diversion enabled through valve 88, similar functionality would be achieved if stream 19 were directly fed to warm recycle circuit 60. In this case flow diversion through valve 88 would be in the opposite direction, to cold circuit 20. Now if the warm turbine feed pressure is highest, valve 87 would be open and valves 88 and 85 would be closed.

While the present invention has been described with reference to several preferred embodiments, it is understood that numerous additions, changes and omissions can be made without departing from the spirit and scope of the present system and method for natural gas and nitrogen liquefaction as set forth in the appended claims.

What is claimed is:

1. A liquefaction system configured to co-produce liquid nitrogen and liquid natural gas, the liquefaction system comprising:

a natural gas feed stream;

a gaseous nitrogen feed stream;

a multi-pass brazed aluminum heat exchanger;

a primary recycle circuit having a primary recycle compressor, a primary booster compressor and a booster loaded primary turbine, the primary recycle circuit configured to: (i) compress the gaseous nitrogen feed stream and a primary gaseous nitrogen recycle stream in the primary recycle compressor to produce a gaseous nitrogen effluent stream; (ii) further compress a remainder portion of the gaseous nitrogen effluent stream in the primary booster compressor to form a primary nitrogen liquefaction stream; (iii) cool the primary nitrogen liquefaction stream in a first heat exchange passage in the multi-pass brazed aluminum heat exchanger to yield a cooled primary nitrogen liquefaction stream; (iv) expand a first portion of the cooled primary nitrogen liquefaction stream extracted at a primary intermediate location of the first heat exchange passage in the booster loaded primary turbine to produce a primary turbine exhaust; (v) warm the primary turbine exhaust in a second heat exchange passage in the multi-pass brazed aluminum heat exchanger to produce the primary gaseous nitrogen recycle stream;

a secondary recycle circuit having a secondary recycle compressor, a secondary booster compressor and a booster loaded secondary turbine, the secondary recycle circuit configured to: (i) receive a secondary recycle stream; (ii) compress the secondary recycle stream in the secondary recycle compressor to form a compressed refrigerant stream; (iii) further compress the compressed refrigerant stream in the secondary booster compressor to yield a further compressed refrigerant stream; (iv) cool the further compressed refrigerant stream in a third heat exchange passage of the multi-pass brazed aluminum heat exchanger to yield a cooled refrigerant stream; and (v) expand the cooled, further compressed secondary recycle stream in the booster loaded secondary turbine to produce a secondary turbine exhaust; (vi) warm the secondary turbine exhaust in a fourth heat exchange passage of the multi-pass brazed aluminum heat exchanger; and (vii) recycle the resulting warmed stream as the secondary recycle stream to the secondary recycle compressor;

a diversion circuit having one or more valves configured to direct a diverted portion of the gaseous nitrogen effluent stream from the primary recycle circuit to the secondary recycle circuit; and a subcooler configured to subcool a second portion of the primary nitrogen liquefaction stream to produce a subcooled liquid nitrogen stream;

the multi-pass brazed aluminum heat exchanger further having a fifth heat exchange passage and a sixth heat exchange passage and configured to liquefy the natural gas feed stream in the sixth heat exchange passage against a first portion of the at least partially vaporized subcooled liquid nitrogen stream in the fifth heat exchange passage;

wherein the liquid nitrogen product stream is a second portion of the subcooled liquid nitrogen stream and the liquid natural gas stream is the liquefied natural gas exiting a cold end of the sixth heat exchange passage.

2. The liquefaction system of claim 1 wherein the primary recycle circuit is a cold recycle circuit; the primary recycle compressor is a cold recycle compressor; the primary booster compressor is a cold booster compressor; the booster loaded primary turbine is a booster loaded cold turbine; the primary gaseous nitrogen recycle stream is a cold gaseous nitrogen recycle stream; the primary intermediate location of the first heat exchange passage is a cold intermediate location of the first heat exchange passage; the primary turbine exhaust is a cold turbine exhaust; the secondary recycle circuit is a warm recycle circuit; the secondary recycle compressor is a warm recycle compressor; the secondary booster compressor is a warm booster compressor; the booster loaded secondary turbine is a booster loaded warm turbine; the secondary gaseous nitrogen recycle stream is a warm gaseous nitrogen recycle stream; and the secondary turbine exhaust is a warm turbine exhaust.

3. The liquefaction system of claim 1 wherein the primary recycle circuit is a warm recycle circuit; the primary recycle compressor is a warm recycle compressor; the primary booster compressor is a warm booster compressor; the booster loaded primary turbine is a booster loaded warm turbine; the primary gaseous nitrogen recycle stream is a warm gaseous nitrogen recycle stream; the primary intermediate location of the first heat exchange passage is a warm intermediate location of the first heat exchange passage; the primary turbine exhaust is a warm turbine exhaust; the secondary recycle circuit is a cold recycle circuit; the secondary recycle compressor is a cold recycle compressor; the secondary booster compressor is a cold booster compressor; the booster loaded secondary turbine is a booster loaded cold turbine; the secondary gaseous nitrogen recycle stream is a cold gaseous nitrogen recycle stream; and the secondary turbine exhaust is a cold turbine exhaust.

4. The liquefaction system of claim 3 wherein the cooled, further compressed cold recycle stream in the third heat exchange passage is extracted from a cold intermediate location of the third heat exchange passage and the cold turbine exhaust is introduced to a cold end of the fourth heat exchange passage.

5. The liquefaction system of claim 4 wherein the extraction of the cooled, further compressed cold recycle stream in the third heat exchange passage is at a temperature colder than the temperature of the cooled, further compressed cold recycle stream adjacent to the warm exhaust stream introduced to the second heat exchange passage.

6. The liquefaction system of claim 1 further comprising a nitrogen feed compressor configured to compress the gaseous nitrogen feed stream upstream of the primary recycle circuit.

7. The liquefaction system of claim 1 further comprising a natural gas feed compressor configured to compress the natural gas feed stream.

8. The liquefaction system of claim 1 further comprising a liquid turbine disposed downstream of the multi-pass brazed aluminum heat exchanger or a throttle valve disposed downstream of the multi-pass brazed aluminum heat exchanger, the liquid turbine and throttle valve are configured to expand the second portion of the primary nitrogen liquefaction stream.

9. The liquefaction system of claim 1 further comprising a vent circuit configured to vent or extract a portion of the secondary recycle stream from the secondary recycle circuit.

10. The liquefaction system of claim 1 wherein the primary recycle compressor and the secondary recycle compressor comprise a single multi-stage compressor where some of the stages of the multi-stage compressor are dedicated to the primary recycle compressor and other stages of the multi-stage compressor are dedicated to the secondary recycle compressor.

11. A method for liquefaction to co-produce liquid nitrogen and liquid natural gas, the method comprising the steps of:

(i) receiving a gaseous nitrogen feed stream in a primary recycle circuit;

(ii) compressing the gaseous nitrogen feed stream and a primary gaseous nitrogen recycle stream in a primary recycle compressor to produce a gaseous nitrogen effluent stream;

(iii) further compressing a remainder portion of the gaseous nitrogen effluent stream in a primary booster compressor to form a primary nitrogen liquefaction stream;

(iv) cooling the primary nitrogen liquefaction stream in a first heat exchange passage in a multi-pass brazed aluminum heat exchanger;

(v) expanding a first portion of the cooled primary nitrogen liquefaction stream extracted at a primary intermediate location of the first heat exchange passage in a booster loaded primary turbine to produce a primary turbine exhaust;

(vi) warming the primary turbine exhaust in a second heat exchange passage in the multi-pass brazed aluminum heat exchanger to produce the primary gaseous nitrogen recycle stream;

(vii) receiving a secondary recycle stream in a secondary recycle circuit;

(viii) compressing the secondary recycle stream in a secondary recycle compressor Q form a compressed refrigerant stream;

(ix) further compressing the compressed refrigerant stream in a secondary booster compressor to yield a further compressed refrigerant stream;

(x) cooling the further compressed refrigerant stream in a third heat exchange passage of the multi-pass brazed aluminum heat exchanger to yield a cooled refrigerant stream;

(xi) expanding the cooled refrigerant stream in a booster loaded secondary turbine to produce a secondary turbine exhaust;

(xii) warming the secondary turbine exhaust in a fourth heat exchange passage of the multi-pass brazed aluminum heat exchanger;

(xiii) recycling the resulting warmed stream as the secondary recycle stream to the secondary recycle compressor;

(xiv) diverting a diverted portion of the gaseous nitrogen effluent stream from the primary recycle circuit to the secondary recycle circuit;

(xv) subcooling the primary nitrogen liquefaction stream to produce the subcooled liquid nitrogen stream;

(xvi) liquefying a natural gas feed stream in a sixth heat exchange passage of the multi-pass brazed aluminum heat exchanger against a first portion of the at least partially vaporized subcooled liquid nitrogen stream in a fifth heat exchange passage of the multi-pass brazed aluminum heat exchanger to produce the liquid natural gas; and (xvii) taking a second portion of the subcooled liquid nitrogen stream as the liquid nitrogen.

12. The method of claim 11 wherein the primary recycle circuit is a cold recycle circuit; the primary recycle compressor is a cold recycle compressor; the primary booster compressor is a cold booster compressor; the booster loaded primary turbine is a booster loaded cold turbine; the primary gaseous nitrogen recycle stream is a cold gaseous nitrogen recycle stream; the primary intermediate location of the first heat exchange passage is a cold intermediate location of the first heat exchange passage; the primary turbine exhaust is a cold turbine exhaust; the secondary recycle circuit is a warm recycle circuit; the secondary recycle compressor is a warm recycle compressor; the secondary booster compressor is a warm booster compressor; the booster loaded secondary turbine is a booster loaded warm turbine; the secondary gaseous nitrogen recycle stream is a warm gaseous nitrogen recycle stream; and the secondary turbine exhaust is a warm turbine exhaust.

13. The method of claim 11 wherein the primary recycle circuit is a warm recycle circuit; the primary recycle compressor is a warm recycle compressor; the primary booster compressor is a warm booster compressor; the booster loaded primary turbine is a booster loaded warm turbine; the primary gaseous nitrogen recycle stream is a warm gaseous nitrogen recycle stream; the primary intermediate location of the first heat exchange passage is a warm intermediate location of the first heat exchange passage; the primary turbine exhaust is a warm turbine exhaust; the secondary recycle circuit is a cold recycle circuit; the secondary recycle compressor is a cold recycle compressor; the secondary booster compressor is a cold booster compressor; the booster loaded secondary turbine is a booster loaded cold turbine; the secondary gaseous nitrogen recycle stream is a cold gaseous nitrogen recycle stream; and the secondary turbine exhaust is a cold turbine exhaust.

14. The method of claim 11 further comprising the step of compressing the gaseous nitrogen feed stream upstream of the primary recycle circuit.

15. The method of claim 11 further comprising the step of compressing the natural gas feed stream prior to the step of liquefying the natural gas feed stream in the sixth heat exchange passage of the multi-pass brazed aluminum heat exchanger.

16. The method of claim 11 further comprising the step of expanding the second portion of the primary nitrogen liquefaction stream in a liquid turbine disposed downstream of the multi-pass brazed aluminum heat exchanger or a throttle valve disposed downstream of the multi-pass brazed aluminum heat exchanger.

17. The method of claim 11 further comprising the step of venting or extracting a portion of the secondary recycle stream from the secondary recycle circuit.

18. A liquefaction system configured to co-produce liquid nitrogen and liquid natural gas, the liquefaction system comprising:

a natural gas feed stream;

a gaseous nitrogen feed stream;

a multi-pass brazed aluminum heat exchanger;

a cold recycle circuit having a cold recycle compressor, a cold booster compressor and a booster loaded cold turbine, the cold recycle circuit configured to: (i) compress the gaseous nitrogen feed stream and a cold gaseous nitrogen recycle stream in the cold recycle compressor to produce a gaseous nitrogen effluent stream; (ii) further compress a remainder portion of the gaseous nitrogen effluent stream in the cold booster compressor to form a primary nitrogen liquefaction stream; (iii) cool the primary nitrogen liquefaction stream in a first heat exchange passage in the multi-pass brazed aluminum heat exchanger to form a cooled primary nitrogen liquefaction stream; (iv) expand a first portion of the cooled primary nitrogen liquefaction stream extracted at a cold intermediate location of the first heat exchange passage in the booster loaded cold turbine to produce a cold turbine exhaust; (v) warm the cold turbine exhaust in a second heat exchange passage in the multi-pass brazed aluminum heat exchanger to produce the cold gaseous nitrogen recycle stream;

a warm recycle circuit having a warm recycle compressor, a warm booster compressor and a booster loaded warm turbine, the warm recycle circuit configured to: (i) receive a warm recycle stream; (ii) compress the warm recycle stream in the warm recycle compressor to form a compressed refrigerant stream; (iii) further compress the compressed refrigerant stream in the warm booster compressor to yield a further compressed refrigerant stream; (iv) cool the further compressed refrigerant stream in a third heat exchange passage of the multi-pass brazed aluminum heat exchanger to yield a cooled refrigerant stream; and (v) expand the cooled refrigerant stream in the booster loaded warm turbine to produce a warm turbine exhaust; (vi) warm the warm turbine exhaust in a fourth heat exchange passage of the multi-pass brazed aluminum heat exchanger; and (vii) recycle the resulting warmed stream as the warm recycle stream to the warm recycle compressor;

a diversion circuit having a valve and configured to direct a diverted portion of the gaseous nitrogen effluent stream from the cold recycle circuit to the warm recycle circuit; and a subcooler configured to subcool a second portion of the primary nitrogen liquefaction stream to produce a subcooled liquid nitrogen stream;

the multi-pass brazed aluminum heat exchanger further having a fifth heat exchange passage and a sixth heat exchange passage and configured to liquefy the natural gas feed stream in the sixth heat exchange passage against a first portion of the at least partially vaporized subcooled liquid nitrogen stream in the fifth heat exchange passage;

wherein the liquid nitrogen product stream is a second portion of the subcooled liquid nitrogen stream and the liquid natural gas stream is the liquefied natural gas exiting a cold end of the sixth heat exchange passage.

19. A liquefaction system configured to co-produce liquid nitrogen and liquid natural gas, the liquefaction system comprising:

a natural gas feed stream;

a gaseous nitrogen feed stream;

a multi-pass brazed aluminum heat exchanger;

a warm recycle circuit having a warm recycle compressor, a warm booster compressor and a booster loaded warm turbine, the warm recycle circuit configured to: (i) compress the gaseous nitrogen feed stream and a warm gaseous nitrogen recycle stream in the warm recycle compressor to produce a gaseous nitrogen effluent stream; (ii) further compress a remainder portion of the gaseous nitrogen effluent stream in the warm booster compressor to form a primary nitrogen liquefaction stream; (iii) cool the primary nitrogen liquefaction stream in a first heat exchange passage in the multi-pass brazed aluminum heat exchanger to form a cooled primary nitrogen liquefaction stream; (iv) expand a first portion of the cooled primary nitrogen liquefaction stream extracted at a warm intermediate location of the first heat exchange passage in the booster loaded warm turbine to produce a warm turbine exhaust; (v) warm the warm turbine exhaust in a second heat exchange passage in the multi-pass brazed aluminum heat exchanger to produce the warm gaseous nitrogen recycle stream;

a cold recycle circuit having a cold recycle compressor, a cold booster compressor and a booster loaded cold turbine, the cold recycle circuit configured to: (i) receive a cold recycle stream; (ii) compress the cold recycle stream in the cold recycle compressor to form a compressed cold recycle stream; (iii) further compress the compressed cold recycle stream in the cold booster compressor to yield a further compressed cold recycle stream; (iv) cool the further compressed cold recycle stream in a third heat exchange passage of the multi-pass brazed aluminum heat exchanger to yield a cooled, further compressed cold recycle stream; and (v) expand the cooled, further compressed cold recycle stream in the booster loaded cold turbine to produce a cold turbine exhaust; (vi) warm the cold turbine exhaust in a fourth heat exchange passage of the multi-pass brazed aluminum heat exchanger; and (vii) recycle the resulting warmed stream as the cold recycle stream to the cold recycle compressor;

a diversion circuit having a valve and configured to direct a diverted portion of the gaseous nitrogen effluent stream from the warm recycle circuit to the cold recycle circuit; and a subcooler configured to subcool a second portion of the primary nitrogen liquefaction stream to produce a subcooled liquid nitrogen stream;

the multi-pass brazed aluminum heat exchanger further having a fifth heat exchange passage and a sixth heat exchange passage and configured to liquefy the natural gas feed stream in the sixth heat exchange passage against a first portion of the at least partially vaporized subcooled liquid nitrogen stream in the fifth heat exchange passage;

wherein the liquid nitrogen product stream is a second portion of the subcooled liquid nitrogen stream and the liquid natural gas stream is the liquefied natural gas exiting a cold end of the sixth heat exchange passage.

20. A method for liquefaction to co-produce liquid nitrogen and liquid natural gas, the method comprising the steps of:

(i) receiving a gaseous nitrogen feed stream in a cold recycle circuit;

(ii) compressing the gaseous nitrogen feed stream and a cold gaseous nitrogen recycle stream in a cold recycle compressor to produce a gaseous nitrogen effluent stream;

(iii) further compressing a remainder portion of the gaseous nitrogen effluent stream in a cold booster compressor to form a primary nitrogen liquefaction stream;

(iv) cooling the primary nitrogen liquefaction stream in a first heat exchange passage in a multi-pass brazed aluminum heat exchanger to form a cooled primary nitrogen liquefaction stream;

(v) expanding a first portion of the cooled primary nitrogen liquefaction stream extracted at a cold intermediate location of the first heat exchange passage in a booster loaded cold turbine to produce a cold turbine exhaust;

(vi) warming the cold turbine exhaust in a second heat exchange passage in the multi-pass brazed aluminum heat exchanger to produce the cold gaseous nitrogen recycle stream;

(vii) receiving a warm recycle stream in a warm recycle circuit;

(viii) compressing the warm recycle stream in a warm recycle compressor to form a compressed warm recycle stream;

(ix) further compressing the compressed warm recycle stream in a warm booster compressor to yield a further compressed warm recycle stream;

(x) cooling the further compressed warm recycle stream in a third heat exchange passage of the multi-pass brazed aluminum heat exchanger to yield a cooled, further compressed warm recycle stream;

(xi) expanding the cooled, further compressed warm recycle stream in a booster loaded warm turbine to produce a warm turbine exhaust;

(xii) warming the warm turbine exhaust in a fourth heat exchange passage of the multi-pass brazed aluminum heat exchanger;

(xiii) recycling the resulting warmed stream as the warm recycle stream to the warm recycle compressor;

(xiv) diverting a diverted portion of the gaseous nitrogen effluent stream from the cold recycle circuit to the warm recycle circuit;

(xv) subcooling the primary nitrogen liquefaction stream to produce the subcooled liquid nitrogen stream;

(xvi) liquefying a natural gas feed stream in a sixth heat exchange passage of the multi-pass brazed aluminum heat exchanger against a first portion of the at least partially vaporized subcooled liquid nitrogen stream in a fifth heat exchange passage of the multi-pass brazed aluminum heat exchanger to produce the liquid natural gas; and (xvii) taking a second portion of the subcooled liquid nitrogen stream as the liquid nitrogen.

21. A method for liquefaction to co-produce liquid nitrogen and liquid natural gas, the method comprising the steps of:

(i) receiving a gaseous nitrogen feed stream in a warm recycle circuit;

(ii) compressing the gaseous nitrogen feed stream and a warm gaseous nitrogen recycle stream in a warm recycle compressor to produce a gaseous nitrogen effluent stream;

(iii) further compressing a remainder portion of the gaseous nitrogen effluent stream in a warm booster compressor to form a primary nitrogen liquefaction stream;

(iv) cooling the primary nitrogen liquefaction stream in a first heat exchange passage in a multi-pass brazed aluminum heat exchanger to yield a cooled primary nitrogen liquefaction stream;

(v) expanding a first portion of the cooled primary nitrogen liquefaction stream extracted at a warm intermediate location of the first heat exchange passage in a booster loaded warm turbine to produce a warm turbine exhaust;

(vi) warming the warm turbine exhaust in a second heat exchange passage in the multi-pass brazed aluminum heat exchanger to produce the warm gaseous nitrogen recycle stream;

(vii) receiving a cold recycle stream in a cold recycle circuit;

(viii) compressing the cold recycle stream in a cold recycle compressor to form a compressed cold recycle stream;

(ix) further compressing the cold recycle stream in a cold booster compressor to yield a further compressed cold recycle stream;

(x) cooling the further compressed cold recycle stream in a third heat exchange passage of the multi-pass brazed aluminum heat exchanger to yield a cooled, further compressed cold recycle stream;

(xi) expanding the cooled, further compressed cold recycle stream in a booster loaded cold turbine to produce a cold turbine exhaust;

(xii) warming the cold turbine exhaust in a fourth heat exchange passage of the multi-pass brazed aluminum heat exchanger;

(xiii) recycling the resulting warmed stream as the cold recycle stream to the cold recycle compressor;

(xiv) diverting a diverted portion of the gaseous nitrogen effluent stream from the warm recycle circuit to the cold recycle circuit;

(xv) subcooling the primary nitrogen liquefaction stream to produce the subcooled liquid nitrogen stream;

(xvi) liquefying a natural gas feed stream in a sixth heat exchange passage of the multi-pass brazed aluminum heat exchanger against a first portion of the at least partially vaporized subcooled liquid nitrogen stream in a fifth heat exchange passage of the multi-pass brazed aluminum heat exchanger to produce the liquid natural gas; and (xvii) taking a second portion of the subcooled liquid nitrogen stream as the liquid nitrogen.

* * * * *